US005178731A

United States Patent [19]

Kivimaa et al.

[11] Patent Number: 5,178,731

[45] Date of Patent: Jan. 12, 1993

[54] DOCTOR FOR A SUCTION ROLL

[75] Inventors: Juha Kivimaa; Lauri Suvanto, both of Jyväskylä, Finland

[73] Assignee: Valmet Paper Machinery Inc., Finland

[21] Appl. No.: 707,462

[22] Filed: May 30, 1991

[30] Foreign Application Priority Data

Jun. 11, 1990 [FI] Finland ..... 902910

[51] Int. Cl.[5] ..... D21F 1/00

[52] U.S. Cl. ..... 162/199; 162/282; 162/272

[58] Field of Search ..... 162/199, 281, 282, 327, 162/272, 274; 15/256.5, 256.51; 100/174; 118/652; 101/425

[56] References Cited

U.S. PATENT DOCUMENTS

| | | | |
|---|---|---|---|
| 2,477,339 | 7/1949 | Ljungquist | 15/256.51 |
| 2,858,747 | 11/1958 | Wagner | 162/361 |
| 3,128,207 | 4/1964 | Schmitt | 15/256.51 |
| 3,198,693 | 8/1965 | Justus | 15/256.51 |
| 3,381,607 | 5/1968 | Clark | 162/272 |
| 4,151,797 | 5/1979 | Dunsirn | 15/256.51 |
| 4,561,379 | 12/1985 | Arav | 15/256.51 |
| 4,789,432 | 12/1988 | Goodnow | 15/256.51 |

*Primary Examiner*—W. Gary Jones
*Assistant Examiner*—Brenda Lamb
*Attorney, Agent, or Firm*—Steinberg & Raskin

[57] ABSTRACT

The invention concerns a method and a device for removing water out of the perforations in a suction roll wherein a doctor blade is brought into contact with the face of the suction roll. The doctor blade is mounted with its slat face in such an angular position in relation to the face of the suction roll that the angle between the face plane of the doctor blade and the tangential direction of the face of the suction roll, when the tangent is drawn at the contact point between the tip of the doctor blade and the face of the suction roll, is from about 2° to about 10°. In the method, water is removed by means of the inlet-side surface plane of the doctor blade, the inlet side being seen in the sense of rotation of the suction roll, and the water is allowed to flow smoothly over the doctor blade out of contact with the construction. According to the invention, water may be additionally removed by means of a suction effect out of the area between the slat face of the doctor blade and the suction roll, negative pressure being produced in the space. The negative pressure produces flow of water out of the perforations or grooves in the suction roll.

10 Claims, 3 Drawing Sheets

DOCTOR FOR A SUCTION ROLL

BACKGROUND OF THE INVENTION

The invention concerns a doctor for a suction roll in a paper machine.

In the prior art, in connection with a suction roll placed against a granite roll, doctor solutions are known in which a doctor is fitted to remove water that has remained in the perforations in the suction roll out of said perforations. However, the prior art solutions are not sufficiently efficient. It follows from this that out of the perforations in the suction roll, water still moves back into the felt and thus, wetting of the felt occurs.

SUMMARY OF THE INVENTION

In view of the above-mentioned objectives and others, the present invention relates to a method and apparatus for removing water that has remained in the perforations in a suction roll by providing a doctor arrangement in which an optimal angle remains between the doctor blade and the face of the suction roll. In the invention, the angle between the doctor blade and the tangent of the face of the suction roll is arranged such that a negative pressure is produced in the space between the same. Due to the effect of the negative pressure, the operation of the doctor blade is made more efficient and any water that may have remained in the perforations in the suction roll is removed out of said perforations.

In the invention, the doctor blade and the suction roll are arranged in relation to one another in such a way that the range of the angle between a face plane of the doctor blade and the tangential direction of the suction roll in the area of the outlet side of the doctor blade is from about 2° to about 10°.

If the range of the angle is larger or smaller than said number of degrees, the desired suction effect is not produced.

Thus, an important aspect of the present invention is to make the support and regulation arrangement of the doctor blade such that e.g., said angle can be adjusted. The frame of the doctor blade is fitted to be pivotal on an articulation point, and it has been fitted so that it can be set against the suction roll by means of the force produced by a loading hose. The frame part of the doctor blade itself is resiliently attached to a fixed base frame so that the doctor blade can be made to comply with the face form of the suction roll in all directions of width.

According to the invention, a plastic rib is preferably used as the doctor blade.

The present invention also relates to a method for removing water out of a suction roll wherein a doctor blade having a slat face is mounted with its slat face in such an angular position in relation to a face of a suction roll that the angle between a face plane of the doctor blade and the tangential direction of a face of the suction roll is within a range of from about 2° to about 10°, when the tangent is drawn at the contact point between the tip of the doctor blade and the face of the suction roll.

In this method, water is preferably removed by means of a inlet-side face plane of the doctor blade, the inlet side being seen in the direction of rotation of the suction roll and the water being allowed to flow smoothly over the doctor blade out of contact with the construction. Water is also preferably removed by means of a suction effect out of the area between the slat face of the doctor blade and the suction roll, negative pressure being produced in the space and the negative pressure producing a flow of water out of perforations or grooves in the suction roll.

The doctor blade in accordance with the invention, which is to be placed against the suction roll, comprises a slat-shaped doctor blade which comprises a slat face. The angle between the face plane of the slat face the tangential direction of the face of the suction roll which is jointly operative with the doctor blade is within a range of from about 2° to about 10°, whereby an area of negative pressure is formed by means of the doctor blade in accordance with the invention between the face of the doctor blade and the face of the suction roll, such that water is efficiently removed by means of the negative pressure out of the perforations and/or grooves in the suction roll.

BRIEF DESCRIPTION OF THE DRAWINGS

The following drawings are illustrative of embodiments of the invention and are not meant to limit the scope of the invention as encompassed by the claims.

DETAILED DESCRIPTION

Figure 1:
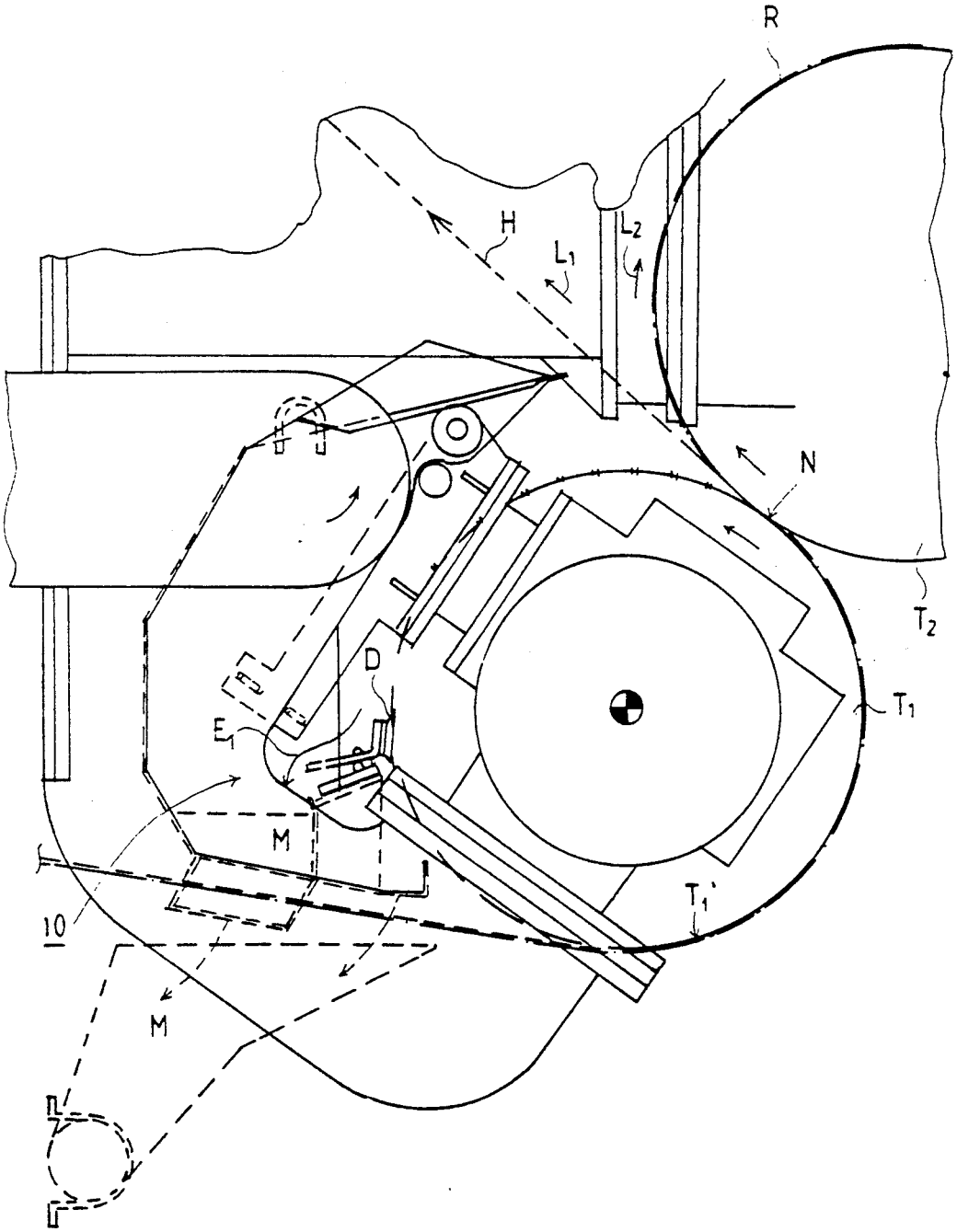
FIG. 1 is a schematic illustration of an arrangement in accordance with the invention.

FIG. 1 shows a doctor construction 10 in accordance with the invention as fitted in its object of use. The doctor construction 10 is fitted in connection with a suction roll jointly operative with a granite roll in the area of the outlet side of the nip N. The senses of rotation of the rolls are indicated by arrows. In a corresponding way, the run of the felt H is denoted with the arrow $L_1$, and the run of the paper web with the arrow $L_2$. The doctor construction 10 is fitted to remove water from the outlet side of the nip N between the suction roll $T_1$ and the granite roll $T_2$, and in particular the doctor 10 is fitted to remove water out of the perforations in the suction roll. Before the doctor construction 10, water is also removed out of the space placed ahead of the doctor blade 11 as the front edge D of the doctor blade 11 guides the flow of the drain water into the sewer system M in the way indicated by the arrow $E_1$.

However, according to the invention, the active effect of the doctor blade is produced by the fact that it has been realized to regulate the angle between the face C of the doctor blade and the face of the suction roll to the range of from about 2° to about 10°, whereby a negative pressure is created in the space V between the face plane C of the doctor blade and the face plane $T_1'$ of the roll $T_1$, which absorbs water efficiently out of the perforations in the suction roll.

Figure 2:
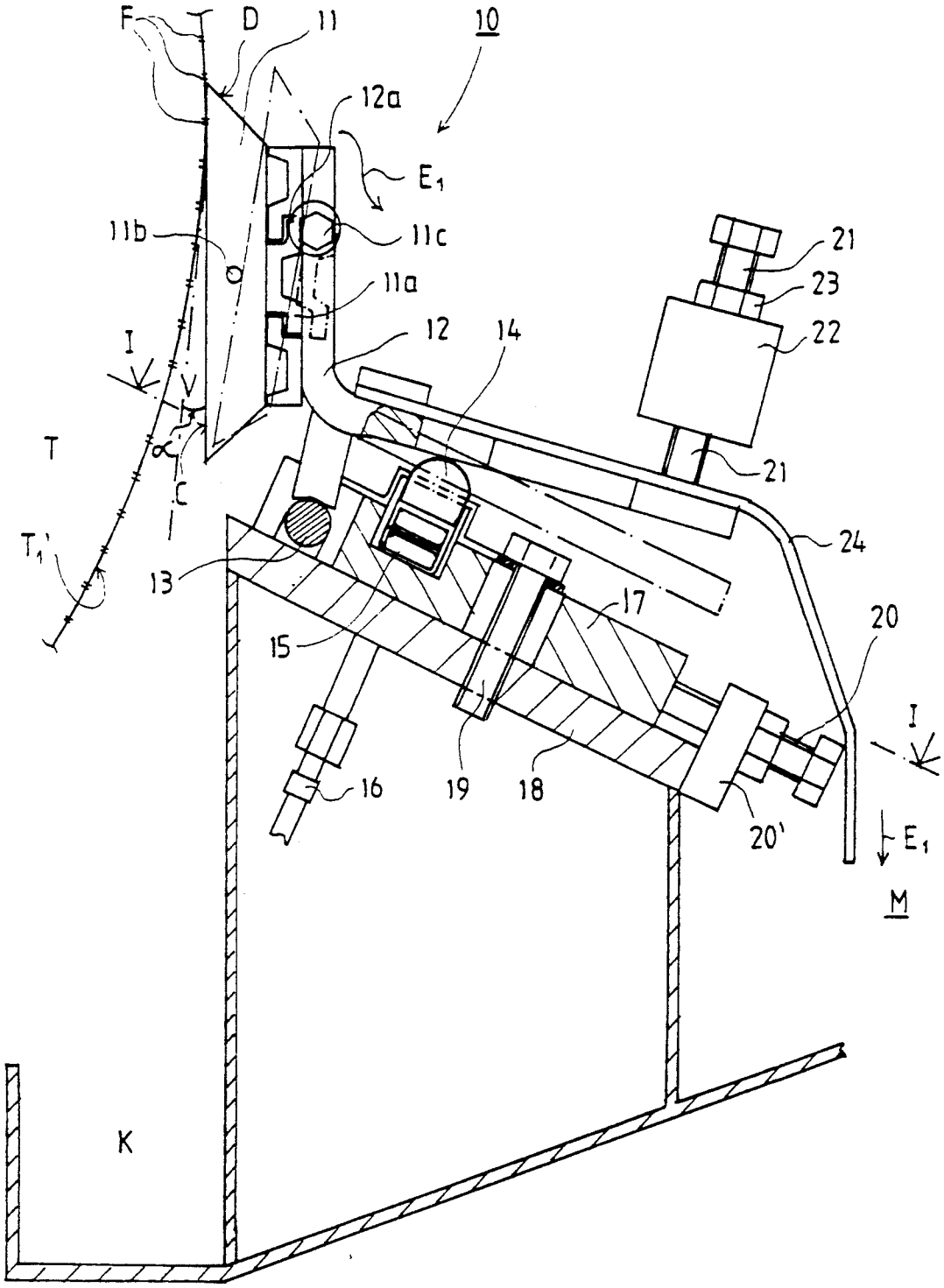
FIG. 2 is a side view of a doctor in accordance with the invention.

FIG. 2 is a more detailed illustration of the doctor construction. A space V remains between the suction roll $T_1$ and the face C of the doctor blade 11 in the doctor construction 10 in which a negative pressure is formed, which absorbs water efficiently out of the perforations F in the suction roll $T_1$. According to the invention, the angle $\alpha$ between the face C of the doctor blade 11 and the tangent of the face $T_1'$ of the suction roll jointly operative with the doctor blade in the area of the outlet side from the contact point between the suction roll and the doctor blade 11, seen in the sense of rotation of the suction roll, is preferably in the range of from about 2° to about 10°. This range of degrees is optimal, and in this range an active suction effect is achieved, such that, as illustrated in FIG. 2, the water is absorbed out of the perforations F and falls down into the drain (collecting) trough K. The slanting blade face D above the doctor blade 11 also collects flowing water and guides said water over the doctor blade construction to be passed, in the way indicated by the arrow $E_1$, into the drain trough and further out of contact with the constructions.

As shown in the figure, the doctor blade 11 is an oblong construction, which is preferably made of plastic and which is attached to the blade frame 12 by means of its holder 11*a*. Advantageously, a T-rail fastening, a dovetail joint, or an equivalent mode of joining is employed, in which case, when a grasping threading 11*b* is grasped by means of a tool, the doctor blade 11 can be pulled apart from the blade frame 12. A lock screw 11*c* prevents falling off of the doctor blade out of the counter-holder 12*a* fitted on the blade frame 12.

The blade frame 12 is fitted to pivot on support of the articulation point 13, and said pivoting is produced loading means 14,15 which act on the articulation point 13. This can be accomplished by displacing a loading piece 14 by means of loading hoses 15. A deformation is produced in the loading hoses by passing compressed air into the loading hoses through a hose 16. The doctor is opened "by its own weight" when the pressure is discharged from the loading hoses. The articulated joint 13 is placed in the base from 17, on which the loading-hose means are also fitted.

In a corresponding way, the whole constructional solution is fixed to the frame part 18 placed underneath by means of screw devices 19. The basic frame 17 is loaded by means of screw devices 20 while the screw is guided by means of the threading in the bracket 20'.

Thus, by means of the screw device 20, the desired transverse deflection is obtained for the base frame 17 and for its articulation points 13, the deformation being transferred further through the blade frame 12 to the blade 11 itself. Thus, the shape of the tip of the blade 11 can be made to comply with the transverse profile and the crown form of the suction roll across the entire width of the suction roll. This circumstance is most preferred if a negative pressure of the correct magnitude is to be provided in the space V between the doctor blade 11 and the fact $T_1'$ of the suction roll $T_1$.

In the figure, the counter-screw is denoted with the reference numeral 21. The counter-screw can be displaced in the bracket 22 and locked by means of a screw 23 in the desired position. Thus, by means of the counter-screw 21, an extreme position can be set forth the pivoting of the blade frame 12. A deformation caused in loading hoses 15 displaces loading piece 14, thereby pivoting the blade frame 12 into contact with the counter-screw 21. By turning the doctor screw 21, the blade frame 12 and the doctor blade 11 can be positioned such that the desired angular position is obtained between the doctor blade 11 and the suction roll $T_1$. By means of a protective shield 24, any splash water and water that flows from the upper face of the blade 11 are passed into the drain system and sewer system M.

Figure 3:
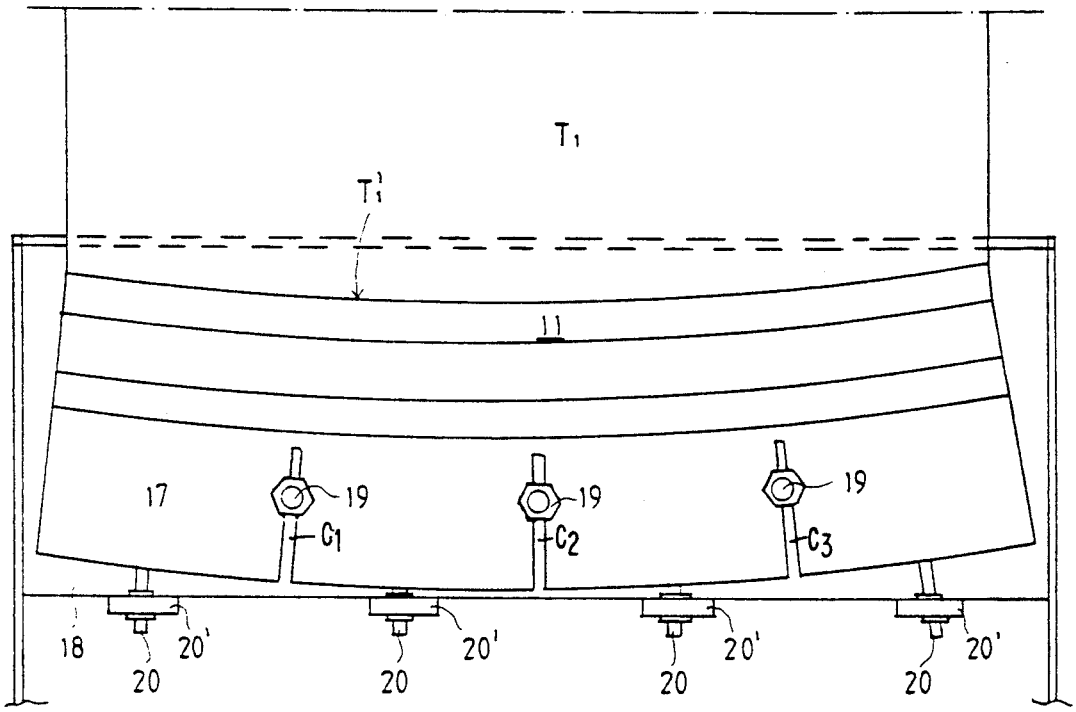
FIG. 3 is a sectional view taken along the line I—I in FIG. 2.

FIG. 3 is a section view taken along the line I—I in FIG. 2. By means of the screw devices 20, the base frame 17 is given the desired transverse shape. The base frame 17 is attached to the stationary frame part 18, which is located below the base frame 17, by means of screws 19 fitted into screw openings 25*a* provided in gaps denoted as $C_1$, $C_2$, $C_3$ open from the side of the base frame. Gaps 25 make it possible that the base frame 17 and, thereby, the blade 11 can be deflected, when tensioned by the loading screws 19, into the shape corresponding to the desired crown form. By means of this arrangement, a bending in the transverse direction can be carried out reliably while the base frame 17 is, nevertheless, kept in tight contact with the stationary frame part 18.

Figure 4:
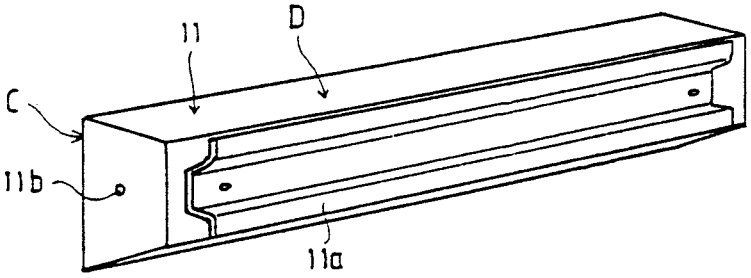
FIG. 4 is an axonometric view of a doctor blade.

FIG. 4 is an axonometric view of a doctor blade 11 made of plastic. By grasping the grasping threading 11*b* by means of a tool, the doctor blade is passed in the transverse direction out of the counter-holder 12*a* of the blade frame 12.

The examples provided above are not meant to be exclusive. Many other variations of the present invention would be obvious to those skilled in the art, and are contemplated to be within the scope of the appended claims.

We claim:

1. A method for removing water from the perforations in a face of a perforated suction roll wherein a doctor blade is brought into contact with the face of the suction roll, comprising mounting a doctor blade such that said doctor blade has an inlet-side face opposing said perforated face of said suction roll and such that a tip of said inlet-side face of said doctor blade contacts said perforated face of said suction roll, arranging said inlet-side face of said doctor blade such that an angle defined between said tip of said doctor blade and said face of said suction roll is within a range of from about 2° to about 10°, such that a negative pressure is produced in an area between said inlet-side face of said doctor blade and said face of said suction roll, removing water from said perforations in said face of said suction roll by means of said doctor blade, such that the water flows smoothly over said doctor blade along said inlet-side face and removing any additional water which remains in said perforations by a suction effect through said perforations in said suction roll caused by the negative pressure produced in said area.

2. The method of claim 1, further comprising adjusting the position of said doctor blade by pivoting said base frame of said doctor blade on an articulation point arranged in said base frame by means of a loading-hose device, and adjusting said doctor blade so that its tip is substantially in compliance with said face of said suction roll operating against said doctor blade by means of a screw device arranged in said base frame, and bringing the base frame of said doctor blade to a desired shape by tensioning said frame by means of said screw device.

3. A doctor construction for removing water out of perforations in a suction roll, comprising a slat-shaped doctor blade having an inlet-side face, a suction roll jointly operative with said doctor, said suction roll comprising a plurality of perforations and/or grooves, said suction roll further comprising a tangential face relative to said doctor blade, a tip of said inlet-side face of said doctor blade contacting said face of said suction roll, said doctor blade structured and arranged such that water present in said perforations in said suction roll is caused to blow smoothly over said doctor blade along said inlet-side face and thus out of contact with said suction roll. the angle between said tip of of said doctor blade and the tangential direction of said face of said suction roll being from about 2° to about 10°, an area of negative pressure thereby being produced between said inlet side face of said doctor blade and said face of said suction roll, such that water is also removed from said perforations in said roll by means of the negative pressure out of said perforations and/or grooves in said suction roll.

4. The doctor construction of claim 3, further comprising a base frame attached to said doctor blade, said base frame having an articulation point, and loading means structured and arranged to cause said base frame of said doctor blade to pivot on said articulation point such that said blade frame is maintained in a position wherein said tip of said doctor blade is positioned against said face of said suction roll.

5. The doctor construction of claim 4, wherein said base frame includes gaps arranged in a transverse direction relative to a direction in which said suction roll revolves, said base frame further including a screw device said base frame being deflectable via said screw device and said gaps so that at all points said tip of said doctor blade corresponds with a transverse profile of said suction roll and thus is placed against said face of said suction roll.

6. The doctor construction of claim 5, further comprising a stationary frame part structured and arranged below said base frame, said base frame being attached to said stationary frame part such that a bending of said base frame in said transverse direction can be carried out while said base frame is kept in tight contact with said stationary frame part.

7. The doctor construction of claim 6, wherein said base frame includes a collecting trough into which the water that has been gathered out of said perforations and/or grooves in said suction roll by the effect of suction is passed.

8. The doctor construction of claim 7, further comprising a counter-screw, said loading means comprising a loading piece displaceable by loading hoses such that a deformation caused in said loading hoses displaces said loading piece, thereby pivoting said blade frame into contact with said counter-screw.

9. The doctor construction of claim 8, wherein said doctor screw, said blade frame and said doctor blade are structured and arranged such that a desired angular position is obtained between said doctor blade and said suction roll by means of said doctor screw.

10. The doctor construction of claim 4, wherein said loading means comprises a loading hose.

* * * * *